United States Patent [19]

Calvert et al.

[11] Patent Number: 4,458,852

[45] Date of Patent: Jul. 10, 1984

[54] WEB TRANSFER APPARATUS

[75] Inventors: Orville M. Calvert, Spartanburg; David O. Dibert, Mauldin; Elie L. Hebert; James B. Tharpe, both of Taylors; Raeford L. Wideman, Mauldin, all of S.C.

[73] Assignee: American Hoechst Corporation, Somerville, N.J.

[21] Appl. No.: 271,053

[22] Filed: Jun. 5, 1981

[51] Int. Cl.[3] ..... B65H 19/26

[52] U.S. Cl. ..... 242/56 A; 83/102.1; 83/304; 83/428

[58] Field of Search ..... 242/56 A, 56.2, 56.5, 242/56.6, 56.7; 83/102.1, 428, 546, 304, 305, 919, DIG. 1

[56] References Cited

U.S. PATENT DOCUMENTS

| | | | |
|---|---|---|---|
| 1,257,853 | 2/1918 | Hansen | 242/56.5 |
| 1,662,200 | 3/1928 | Merrill . | |
| 2,343,047 | 2/1944 | Doyle et al. | 242/56 R |
| 2,769,600 | 11/1956 | Kwitek et al. | 242/56.6 |
| 2,942,796 | 6/1960 | Gurney et al. | 242/56 A |
| 2,984,426 | 5/1961 | Johnson | 83/428 X |
| 3,068,528 | 12/1962 | Owens . | |
| 3,529,785 | 9/1970 | Mistele | 242/56 A |
| 3,625,813 | 12/1971 | Eckelman | 162/286 |
| 3,743,197 | 7/1973 | Hawkins | 242/56.6 |
| 3,752,412 | 8/1973 | Byrt | 242/56 A |
| 3,756,527 | 9/1973 | Collins et al. | 242/56.2 |
| 3,794,256 | 2/1974 | Schwarz | 242/56 A |
| 3,796,388 | 3/1974 | Davis | 242/56 A |
| 3,814,342 | 6/1974 | Fujiwara | 242/56 A |
| 3,871,595 | 3/1975 | Smolderen | 242/56 A |
| 3,892,012 | 7/1975 | Keferstein | 242/56 A |
| 4,033,521 | 7/1977 | Dee | 242/56 A |
| 4,038,121 | 7/1977 | Benson et al. | 156/157 |
| 4,040,574 | 9/1977 | Johnson | 242/56 A |
| 4,058,267 | 11/1977 | Schuttler | 242/56 A |
| 4,069,986 | 1/1978 | Carlsen | 242/56 A |
| 4,201,620 | 11/1978 | Platt et al. | 156/494 |
| 4,280,669 | 7/1981 | Leanna et al. | 242/56 A |
| 4,398,678 | 8/1983 | Kron et al. | 242/56.3 |

FOREIGN PATENT DOCUMENTS

| | | |
|---|---|---|
| 1574300 | 8/1971 | Fed. Rep. of Germany . |
| 2301193 | 7/1974 | Fed. Rep. of Germany . |
| 2534588 | 2/1977 | Fed. Rep. of Germany . |

*Primary Examiner*—John M. Jillions

*Attorney, Agent, or Firm*—Richard S. Roberts; James R. Cartiglia

[57] ABSTRACT

An apparatus and method for transferring a moving web from one windup core to another windup core comprising a plurality of rotatable core chucks mounted on a revolvable turret, means for leading said web towards said cores, and means for forming and severing a leader strip of web material for subsequent securing to an empty cylindrical windup core.

23 Claims, 5 Drawing Figures

WEB TRANSFER APPARATUS

BACKGROUND OF THE INVENTION

In the production of continuous webs of flexible materials, such as thermoplastic films, such films are conventionally wound on a cylindrical core until the desired length of material has been obtained. It has been a significant problem in the art to efficiently transfer the web material from a fully wound core to a fresh empty core for continued production.

It has been known in the art to provide means to transfer a continuous web from one windup core to another. Principally, these employ a plurality of cores or spindles which are mounted upon an indexable turret arrangement. Typically, when one core has been filled, the turret rotates the empty core into winding position, the web is stopped, cut from the full core and attached to the new core. The fresh core is then wound with web material.

A problem with this method is that a significant amount of production time is lost during the course of a day when the web must be stopped and started up again. Also, the constant attention and action of an operator is required during the course of this change-over. Furthermore, the windup operation is only the last step of a series of complex web production sequences. Typically, the prior production steps must be maintained at a continuous uninterrupted speed which cannot be stopped without serious production consequences. For example, biaxially oriented polyethylene terephthalate film is produced by continuously melting and extruding polymer onto a casting drum, then stretching and heating in a precisely timed sequence. Stopping, slowing or interrupting the production line therefore detrimentally affects many upstream operations with a consequential loss of production and valuable materials.

In an effort to avert these losses, various methods have been tried. One method is to store the continuously produced web material in an accumulator. Typically, these are a series of translatable rollers which spread apart and store the web produced during the core stoppage and then contract, giving up their stored web when the new core is in place and winding. This method is disadvantageous since the accumulator has only a limited storage capacity and itself must occupy a substantial amount of valuable production space. Also, overall production is still limited since web transfer must still take place with the web stopped or slowed at the windup station.

Subsequent methods have attempted to instantaneously cut and transfer the web to the new core in a single operation, thus essentially preserving a continuous production cycle. One such device is shown in U.S. Pat. No. 2,942,796. The problem with this instantaneous severing is, as is disclosed, that inertia must be overcome in starting up the new roller; that is, the new roller is stopped at transfer and then begins to pick up to its operating speed. During this time, upstream web production must still be accumulated by some appropriate method. Other methods employ pressing rollers and brushes in conjunction with travelling cutters to effect web transfer.

SUMMARY OF THE INVENTION

The present invention provides an apparatus for transferring a moving web of a flexible material from a first windup core to a second windup core without stopping said web. The apparatus comprises:

(a) a plurality of rotatable, speed adjustable windup stations mounted on revolvably indexable turret means, and (b) directing means for leading said web towards said windup stations; and (c) a flying knife assembly comprising a pair of spaced cutting means mounted for translation along at least one path, which path or paths are positioned parallel to the plane of said web path between said turret means and said directing means, said flying knife assembly further comprising means for inserting and retracting said cutting means into and out of the plane of said web path, being capable of forming a leader strip comprising a portion of said web materials; and (d) severing means for completely transversely cutting said leader strip; and (e) fastening means for securing said leader strip to said second windup core.

The present invention also provides a method for transferring a moving web of a flexible material from one windup core to another windup core without stopping said web. This method comprises the steps of:

(a) winding a moving web of said flexible material around a first windup core; and (b) automechanically forming a leader strip of web material, said strip comprising a portion of said web cut parallel to the direction of travel of said web, the non-leader portion of the web defining the balance of the web; and (c) automechanically cutting said leader strip completely across its width; and (d) automechanically adhering said leader strip to the surface of said second windup core; and (e) automechanically winding said leader strip around said second windup core while winding the balance of said web material around said first windup core; and (f) automechanically completely cutting the width of said balance of said web material either after step (b) or after step (d) or after step (e).

DETAILED DESCRIPTION OF THE PREFERRED EMBODIMENT

As hereinbefore mentioned, the present invention provides an apparatus and method for transferring a moving web of a flexible material from a first windup core to a second windup core. The apparatus broadly comprises:

(a) a plurality of rotatable, speed adjustable windup stations mounted on revolvably indexable turret means; and (b) directing means for leading said web towards said windup stations; and (c) a flying knife assembly comprising a pair of spaced blades mounted for translation along at least one path, which path or paths are positioned parallel to the plane of said web path between said turret means and said directing means, said flying knife assembly further comprising means for inserting and retracting said cutting means into and out of the plane of said web path, being capable of forming a leader strip comprising a portion of said web material; and (d) severing means for completely transversely cutting said leader strip; and (e) fastening means for securing said leader strip to said second windup core.

It is within the contemplation of the present invention that the cutting means could either both cut into the web, thus forming the leader therebetween or one cutting means could cut the web and the other cutting means is positioned parallel to the first cutting means outside the periphery of the web. Thus, the leader would be formed between the cutting means, yet only one incision would be made.

The method comprises the steps of:

(a) winding a moving web of said flexible material around a first windup core; and (b) automechanically forming a leader strip of web material, said strip comprising a portion of said web cut parallel to the direction of travel of said web, the non-leader portion of the web defining the balance of the web; and (c) automechanically cutting said leader strip completely across its width; and (d) automechanically adhering said leader strip to the surface of said second windup core; and (e) automechanically winding said leader strip around said second windup core while winding the balance of said web material around said first windup core; and (f) automechanically completely cutting the width of said balance of said web material either after step (b) or after step (d) or after step (e).

Automechanically means the use of a mechanism which is relatively self moving and designed to follow a predetermined sequence of operations. Although human intervention is normally not necessary, one may control, e.g. stop, start or interrupt the operations.

Figure 1:
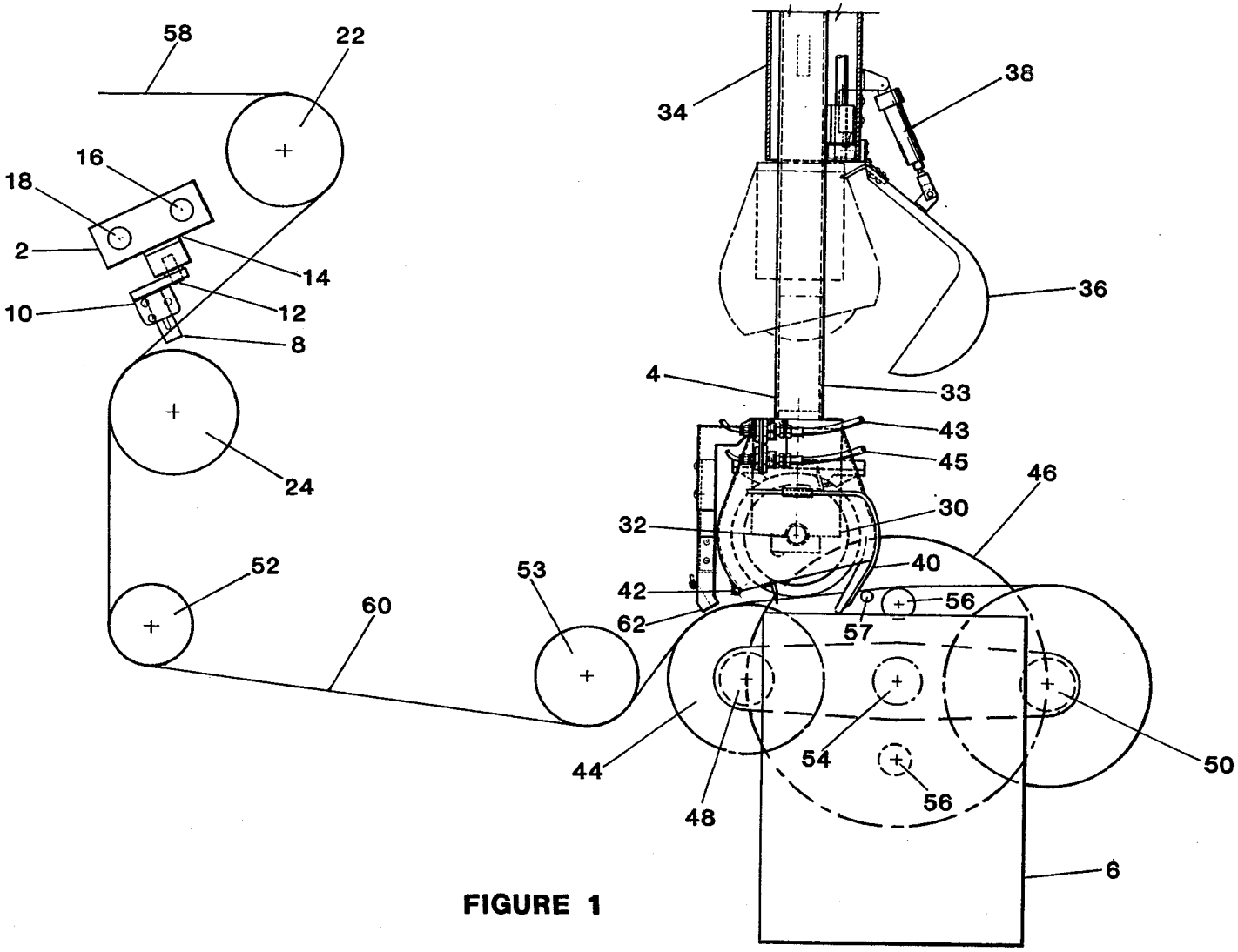
FIG. 1 shows a side elevational view of the apparatus of the present invention.

FIG. 1 describes one embodiment of the present invention. It is shown to comprise a flying knife assembly 2, a web cutter assembly 4 and a windup assembly 6.

Figure 2:
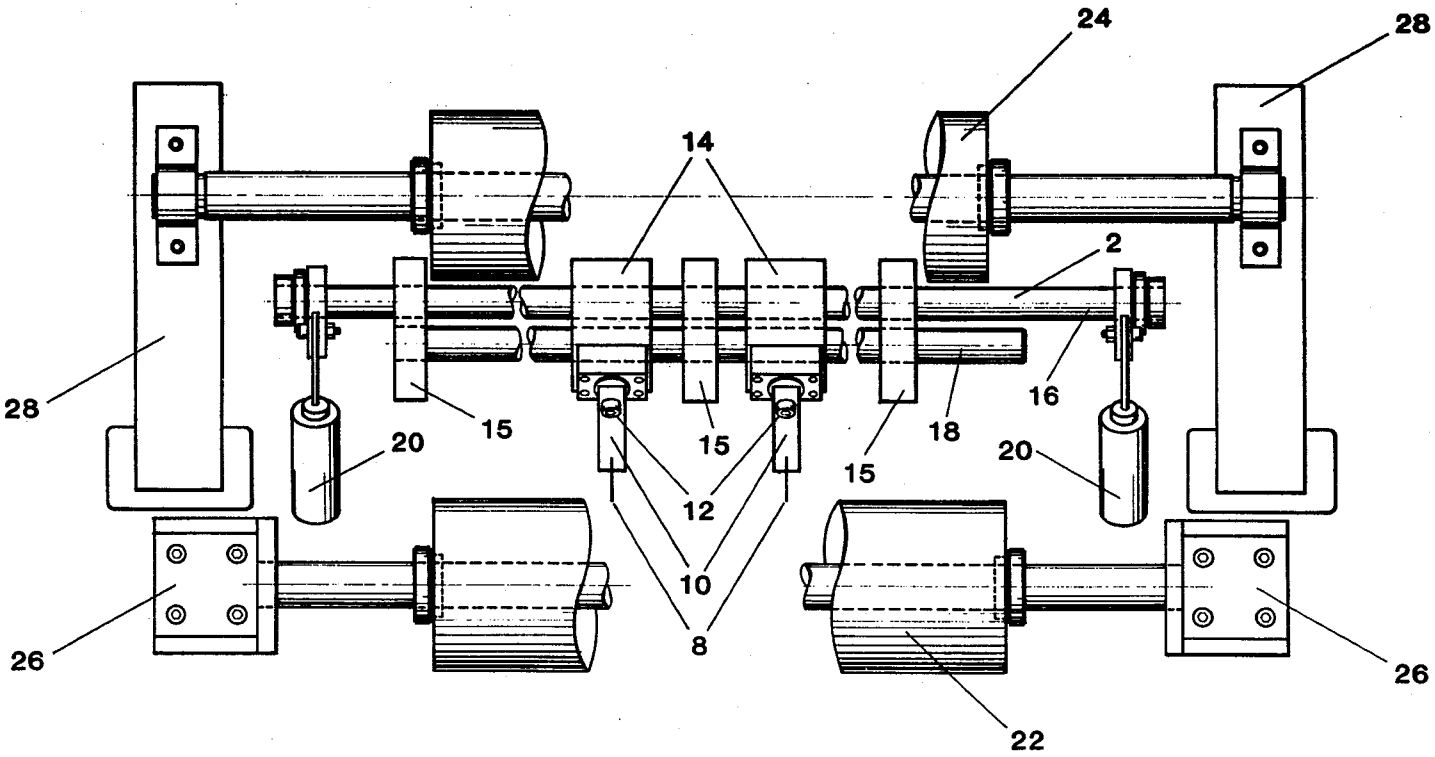
FIG. 2 describes a flying knife arrangement.

Flying knife assembly 2 is shown in more detail in FIG. 2. This is shown to comprise cutting means which in the preferred embodiment comprises a pair of blades 8 mounted in supporting blocks 10. These blocks are preferably attached via pivots 12 to sliding mounts 14. These mounts 14 are capable of sliding along a path, here shown by shafts 16 and 18 under the influence of suitable urging and controlling means, not shown. These are monitored by appropriate stops and spacers 15. Such paths could, for example, be defined by channels. The cutting means could also comprise a laser, a jet of a fluid such as water, a jet of an abrasive, an incandescent wire, or a hot or cold pin. Each of the foregoing cutting means include the particle stream or energy which they emit. Although FIG. 2 shows the cutting means to be movable along a common linear path, it is within the contemplation of the present invention that the cutting means could be mounted for translation along divergent paths as long as the paths are parallel to the plane of web travel.

The flying knife assembly may be mounted for vertical pivot translation by means, such as piston means 20. This piston means permits the cutting means assembly to be inserted into and retracted out of the path of a moving web passing from idle roller 22 to idle roller 24. These rollers are respectively mounted for rotation on bearings 26 and 28. In an alternate embodiment the entire flying knife assembly could translate perpendicularly to the web path for insertion of the cutting means into the web.

In still another embodiment, the entire flying knife assembly 2 is mounted for translation in a track-like arrangement, not shown. This arrangement allows the flying knife assembly to move parallel to the direction of web travel when the knives are inserted into the web. This allows control of waste, tear control, minimizes web distortion and spreads out web wrinkles. This adjusts leader taper angle.

Figure 3:
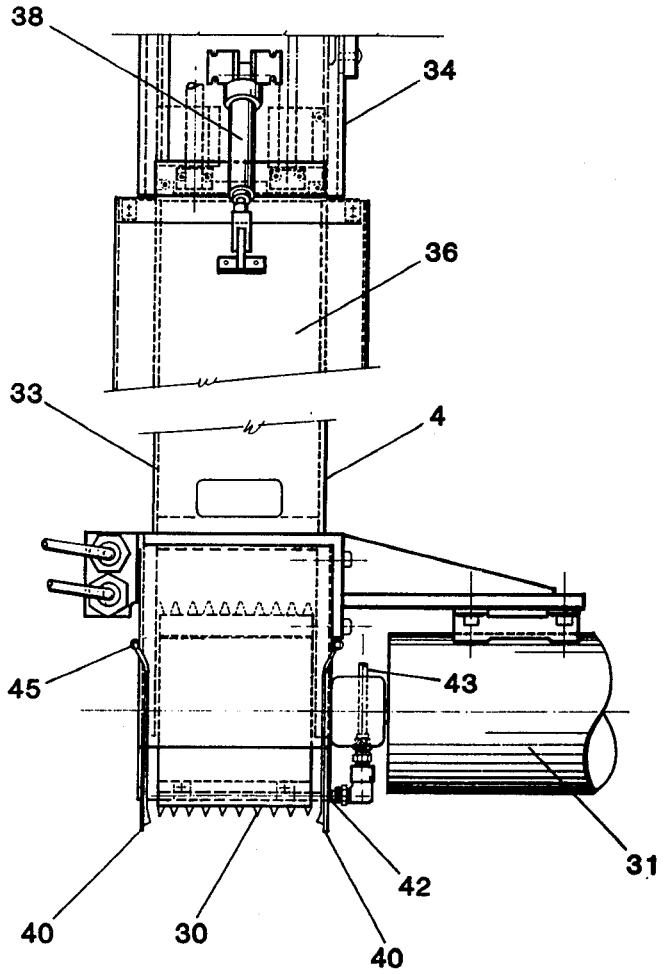
FIG. 3 shows a front elevational view of one leader cutter embodiment using a plurality of rotating blades.

Web cutter assembly 4, as is shown in FIGS. 1 and 3, comprises cutting means 30 mounted for translation on support 33. Said support being capable of inserting and retracting cutting means 30 into and out of the path of the leader strip formed by the flying knife assembly. In one embodiment of the present invention cutting means 30 comprises a plurality of serrated blades mounted for rotation via motor 31 about an axis 32 set on support 33. Support 33 is preferably a shaft capable of telescope-like translation through tube 34. When shaft 33 is in the fully retracted position, lid 36, operated by control means 38, covers cutting means 30.

In a preferred embodiment, the web cutter assembly carries a pair of web spreaders 40 on opposite sides of cutting means 30. These web spreaders are inserted into the slits formed by the aforementioned flying knife assembly and facilitates the cutting of the leader strip between the slits by the web cutter by guiding the edge of the balance of the web on the outer sides of the slits, away from the leader strip in the severance area. This action facilitates the positive cutting and transfer of the leader strip to the empty windup core. As an option, web spreaders 40 may have a tubular bore therethrough or may bear hollow tubes on their outer surface. Such tubular passageways would permit the web spreaders to spray an adhesive fluid, such as water, between the leader strip and the empty core as an aid to assured leader to core transfer. This arrangement is superior to the use of an adhesive coated core since this permits core re-use. As a further aid to assured web transfer, optional use may be made of leader transfer means which may be an airjet 42 across the cutter width to force the leader strip onto new windup core 44. These air and fluid passageways are fed by appropriate conduit means 43 and 45 respectively.

Windup assembly 6 typically comprises a pair of rotatable, position indexable turret drums 46 which carry at least two windup stations 48 and 50. A windup station is either a rotatable spool driven by the turret or a pair of core chucks, one mounted on each turret drum opposite each other which are capable of holding and rotating a removable windup core. The turret drums shift a fully wound core to the removal position and substitute an empty core into the winding position.

In the operation of the embodiment described in the drawings, flying knife assembly 2 is normally in its retracted position, i.e. with the cutting means, here a blade, out of the web. Likewise, web cutter 4 is positioned so that shaft 33 is fully contracted within tube 34. The web is continuously fed via directing means such as rollers 22, 24, 52 and 53 to windup core 44 set in the position designated 48. When this core is nearly full, turret drum 46 rotates clockwise about pivot 54 so that core 44 is now in position 50. The web is guided to core 44 in position 50 over one of the guide rollers 56. Flying knife blocks 14 are then positioned, preferably, centered above web 58 approximately six inches apart. Pistons 20 then force the knives on shaft 16 down to pierce the web, thus forming at least one slit, preferably, centered parallel slits in the web. The web portion between the slits is to become the leader strip for the new core. Slit web 60 is now directed toward the windup cores as web cutter 4 commences operation. Control means 38 opens lid 36 and shaft 33 descends toward the web. Blades 30 revolve around axis 32. Web spreaders 40 enter parallel slits in the web and spread the edge of the balance of the web material slightly away from the leader. The tubes associated with the web spreaders then spray water or another adhesive on the new windup core under the leader strip. Shaft 33 then forces the cutter against the leader strip, completely cutting the leader between the slits. Leader transfer means 42, in this case an airjet, then urges the severed leader strip onto the water sprayed core. Shaft 33 then retracts. At this point the leader is winding onto the empty core at position 48 and the balance of the web is being wound onto the core at position 50. In the preferred embodiment, the empty core is brought up to the speed of the web prior to web transfer. Optionally, the empty core may operate at a surface speed faster or slower than the web speed before transfer and then adjusted to web speed after transfer. This is extremely advantageous for a continuous web production process since web production remains constant. This also allows use of varying core sizes. Flying knives 8 are now directed outwardly toward the ends of shaft 16 thus cutting the web sides completely. Piston 20 then disengages, taking the knives out of the web path. The flying knife assembly may then be reset for the next cycle. These web sides are wound upon the core in position 50 while the leader pulls the new full width web for windup on the core in position 48.

An important feature of the flying knives 8 is that they are preferably pivotably mounted on slides 14 so as to be essentially self-aligning. That is, their optimum angle of pivot is determined by the web parameters such as its thickness, composition and speed. Furthermore, their positioning permits this one apparatus to cut any of an indefinite number of web widths, constrained only by the shaft size.

As can be readily appreciated, several additional modifications to the described preferred embodiment can be employed to improve web transfer performance in various particular circumstances and are considered within the scope of the present invention. For example, for very wide webs, the transverse tension across the web width is not always uniform. This difference is exacerbated after slitting. In such a case, it is advantageous to employ a means 57 to increase leader tension during the transverse leader cut and transfer operation. An example of such a leader tensioning means is a pressure bar, or roller or sponge pressed against the leader strip in the vicinity of the web cutter. Such leader tensioning means could optionally also place an adhesive such as water between the leader and the new windup core. Appropriate control means would be provided to engage and disengage the tensioning means.

Figure 5:
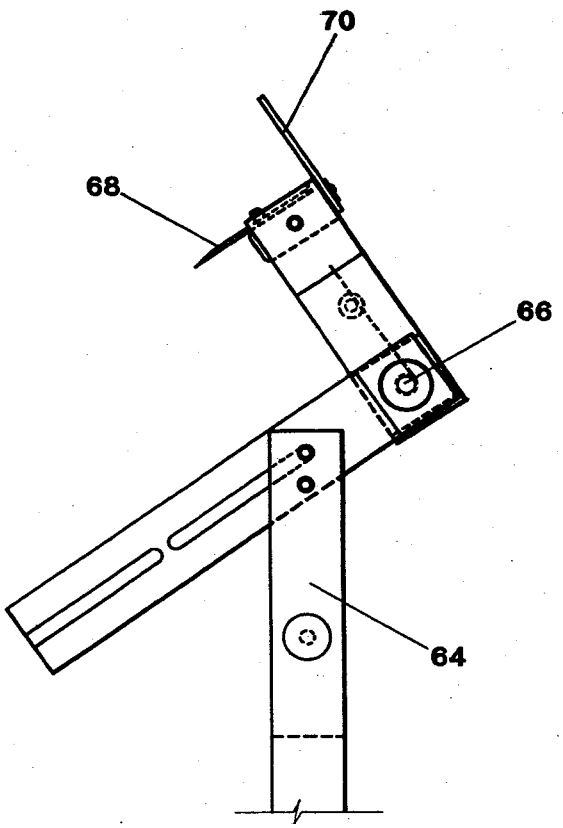
FIGS. 4 and 5 show an alternate leader cutter embodiment using a guillotine type cutting arrangement.
Figure 4:
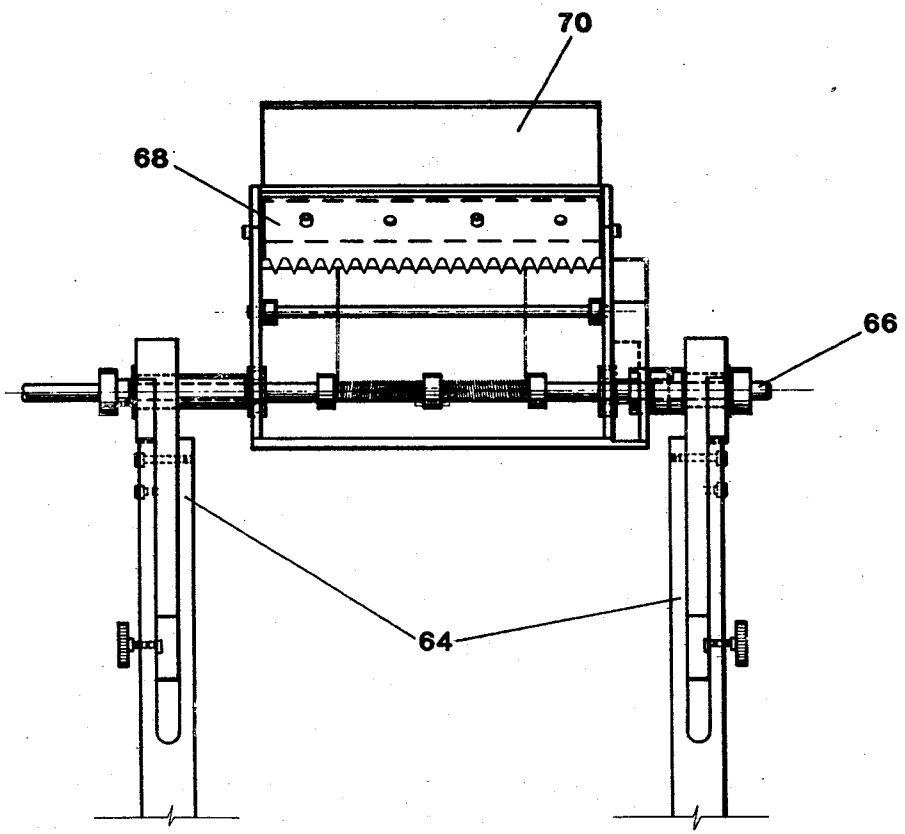

FIGS. 4 and 5 show an alternate type of web cutter to that heretofore described. This guillotine type cutter 64 would operate via a powered pivot 66 to instantaneously interject the blade 68 into the leader strip. This blade with powered pivot would be mounted on shaft 33 in lieu of circular cutting means 30. Preferably the pivot would cause the blade to arc in the direction of web motion. Such an arrangement could advantageously employ a flexible leader attachment means 70. Typically, this would comprise a rubber or other similar strip, mounted parallel to the guillotine blade. This attachment means would urge the severed leader end positively onto the new windup core.

As an alternate means of achieving positive leader attachment to metal or dielectric cores is an electrostatic pinning technique.

By this method the leader strip is drawn close to a thin current carrying wire or other conductor at the end of arm 62, thus imparting an electrostatic charge to the web. When this web leader is drawn in proximity to the core, the electrostatic forces cause a positive leader adhesion to the core. All that is required for adhesion is a potential difference between the core and the web.

Other features useful in the context of this invention include static eliminators near the web approaching the winding station and the use of a nip roller adjacent to the windup roller to control web tension, direction and windup roller speed. Also of use in this invention is a spreader roll positioned before the windup core which serves to eliminate wrinkles in the web. Such spreader rolls have surfaces which are bowed or have a chevron pattern or contain slats with varying heights to smooth wrinkles over the web surface.

It is, of course, appreciated that variations and modifications from the described preferred embodiment are possible without departing from the spirit and scope of the invention.

What is claimed is:

1. An apparatus for transferring a moving web of a flexible material from a first windup core to a second windup core which comprises:

(a) a plurality of rotatable, speed adjustable windup stations mounted on revolvably indexable turret means; and (b) directing means for leading said web towards said windup stations; and (c) a flying knife assembly comprising a pair of spaced cutting means mounted for translation along at least one path, which path or paths are positioned parallel to the plane of the web path between said turret means and said directing means, said flying knife assembly further comprising means for inserting and retracting said cutting means into and out of the plane of said web path, being capable of forming a leader strip comprising a portion of said web material; and (d) severing means for completely transversely cutting said leader strip; and (e) means for increasing the tension on said leader strip prior to cutting said leader strip by said severing means; and (f) means for matching the speed of said second windup core to the speed of said web; and (g) fastening means for securing said leader strip to said second windup core while the balance of said web is being wound on said first windup core.

2. The apparatus of claim 1 further comprising web spreader means capable of deflecting the edge of the balance of the web from the leader strip.

3. The apparatus of claim 1 further comprising means for applying an adhesive between said leader strip and said second windup core.

4. The apparatus of claim 1 wherein said path is defined by slidably mounting said pair of spaced cutting means on a shaft.

5. The apparatus of claim 4 wherein at least one of said cutting means comprises a blade.

6. The apparatus of claim 5 wherein said blades are fastened to blade securing means capable of pivoting said blades about an axis perpendicular to the transverse axis to said shaft.

7. The apparatus of claim 1 wherein said severing means comprises at least one blade having about the width of said leader strip, said blade or blades being mounted for rotation about an axis parallel to the plane of said leader strip, and means for rotating said blade or blades about said axis, and means for inserting and retracting said blade or blades into and out of the leader strip path.

8. The apparatus of claim 1 wherein said severing means comprises a blade having about the width of said leader strip, and being mounted upon a fulcrum for traversing an arcuate path, and means for causing said blade to traverse said arcuate path and be reset to its original position, and means for inserting and retracting said blade traversing said arcuate path into and out of the path of said leader strip.

9. The apparatus of claim 1 wherein said fastening means comprises airjet means for forcing said leader strip onto said second windup core.

10. The apparatus of claim 1 wherein said fastening means comprises means for imparting an electrostatic charge to said web.

11. The apparatus of claim 1 wherein said fastening means comprises a resilient slapper, and means for urging said slapper onto said leader strip and then onto said second cylindrical core.

12. The apparatus of claim wherein at least one of said cutting means comprises a laser.

13. The apparatus of claim 1 wherein at least one of said cutting means comprises an incandescent wire.

14. The apparatus of claim 1 wherein at least one of said cutting means comprises a jet of a fluid.

15. The apparatus of claim 1 wherein at least one of said cutting means comprises a jet of an abrasive.

16. The apparatus of claim 10 wherein said electrostatic charge is imparted by drawing said web into proximity with a current-carrying wire.

17. The apparatus of claim 1 wherein at least one of said cutting means comprises a pin.

18. A method for transferring a moving web of a flexible material from a first windup core to a second windup core which comprises:

(a) winding a moving web of said flexible material around a first windup core; and (b) automechanically forming a leader strip of web material by means of a flying knife assembly comprising a pair of spaced cutting means, said leader strip comprising a portion of said web cut parallel to the direction of travel of said web, the non-leader portion of the cut web defining the balance of the web; and (c) automechanically deflecting the edge of the balance of said web width away from said leader strip; and (d) automechanically increasing the tension on said leader strip; and (e) automechanically severing said leader strip completely across its width by means of a web cutter assembly comprising a cutting means comprising a blade or plurality of blades; and (f) automechanically contacting said leader strip with the surface of said second windup core; and (g) automechanically adhering said leader strip to the surface of said second windup core; and (h) automechanically matching the speed of said second windup core to the speed of said web; and (i) automechanically winding said leader strip around said second windup core while winding the balance of said web material around said first windup core; and (j) automechanically completely cutting the width of said balance of said web material either after step (b) or after step (f) or after step (i).

19. The method of claim 18 further comprising the step of applying an adhesive between said leader strip and said second windup core.

20. The method of claim 18 wherein said step (j) comprises translating a flying knife assembly parallel to the direction of said web path.

21. The method of claim 18 wherein said step (f) comprises forcing said leader strip onto said second windup core by means of an airjet.

22. The method of claim 18 wherein said step (g) comprises imparting an electrostatic charge on said web.

23. The method of claim 18 wherein said step (f) comprises urging a resilient slapper onto said leader strip and then onto said second cylindrical core.

* * * * *